US005297309A

United States Patent [19]

Rotoli

[11] Patent Number: 5,297,309

[45] Date of Patent: Mar. 29, 1994

[54] DEVICE FOR DISINFECTING AND CLEANING PARTS OF PERSONS, ANIMALS AND OBJECTS PASSING OVER IT AND CONTACTING THE GROUND

[76] Inventor: Antonio Rotoli, Via Trionfale N.76, 00195 Roma, Italy

[21] Appl. No.: 853,764

[22] PCT Filed: Nov. 12, 1990

[86] PCT No.: PCT/IT90/00093

§ 371 Date: Jun. 1, 1992

§ 102(e) Date: Jun. 1, 1992

[87] PCT Pub. No.: WO91/08701

PCT Pub. Date: Jun. 27, 1991

[30] Foreign Application Priority Data

Dec. 7, 1989 [IT] Italy ..... 36087 B/89

[51] Int. Cl.[5] ..... A47L 23/24

[52] U.S. Cl. ..... 15/104.92; 15/215; 15/216; 15/238

[58] Field of Search ..... 15/104.92, 215, 216, 15/217, 237, 238, 239, 240, 241; 16/4, 7, 8, 16; 404/35, 36, 40; 52/180, 816

[56] References Cited

U.S. PATENT DOCUMENTS

| | | | |
|---|---|---|---|
| 232,408 | 9/1880 | Lilly | 15/216 |
| 2,282,672 | 5/1942 | Nelson | 15/104.92 |
| 2,989,965 | 6/1961 | Rod . | |
| 3,245,104 | 4/1966 | Bobrowski | 16/7 |
| 3,450,429 | 6/1969 | Stata | 15/238 |
| 3,578,738 | 5/1971 | Hughes | 15/215 |
| 3,696,459 | 10/1972 | Kucera et al. | 15/104.92 |
| 4,029,834 | 6/1977 | Bartlett | 15/215 |
| 4,425,677 | 1/1984 | Cox | 15/104.92 |
| 4,964,187 | 10/1990 | Dell'Orto | 15/217 |
| 5,071,628 | 12/1991 | Alazet | 15/215 |

FOREIGN PATENT DOCUMENTS

| | | | |
|---|---|---|---|
| 890907 | 2/1982 | Belgium . | |
| 60148 | 9/1982 | European Pat. Off. . | |
| 2034090 | 2/1972 | Fed. Rep. of Germany | 15/217 |
| 2639289 | 3/1978 | Fed. Rep. of Germany . | |
| 4103962 | 8/1992 | Fed. Rep. of Germany | 15/216 |
| 2555035 | 5/1985 | France . | |
| 2604887 | 4/1988 | France | 15/215 |
| 2631532 | 11/1989 | France | 15/104.9 |
| 199510 | 4/1922 | United Kingdom | 15/216 |

*Primary Examiner*—Philip R. Coe
*Assistant Examiner*—Tony G. Soohoo
*Attorney, Agent, or Firm*—Michael J. Striker

[57] ABSTRACT

The device for disinfecting parts of persons, animals and objects passing over it and coming into contact with it and the ground, especially the soles of shoes, includes a doormat provided with a rectangular aperture; a shallow flat-bottomed rectangular tray having a bottom and vertical sides made from metal and shaped to form a channel having a C-shaped transverse cross-section opening outwards, the flat-bottomed tray being dimensioned so that the tray can fit in the aperture with edge portions of the door mat engaged in the channel; a sheet of rectangular spongy material which fits in the shallow flat-bottomed rectangular tray; a portion of a disinfecting liquid impregnating the sheet of spongy material; and an elastic grating resting freely on the sheet of spongy material and having an elasticity so that, when depressed by the parts of the persons, animals and objects the grating flexes sufficiently to compress the sheet of the spongy material sufficiently to force disinfecting liquid residing in the spongy material through the elastic grating to the parts to be cleaned and/or disinfected.

4 Claims, 2 Drawing Sheets

FIG. 1
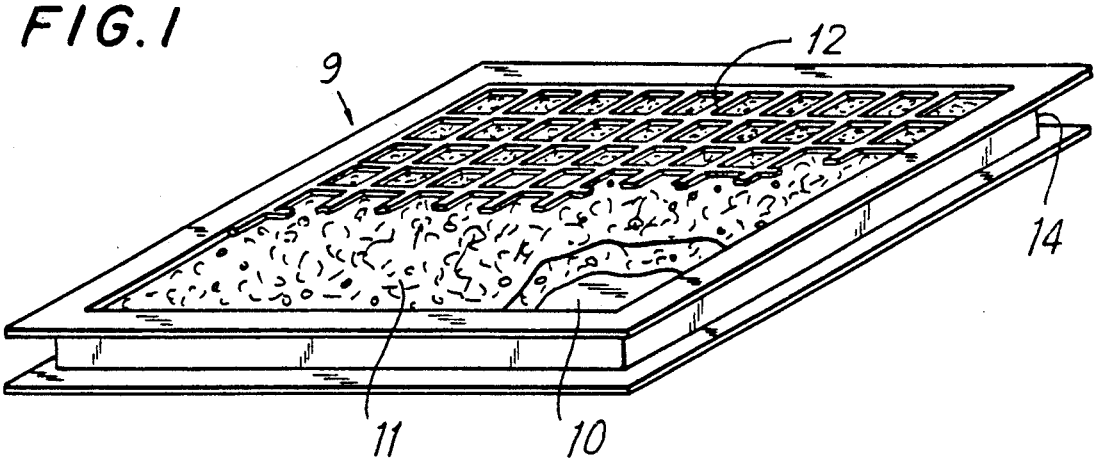
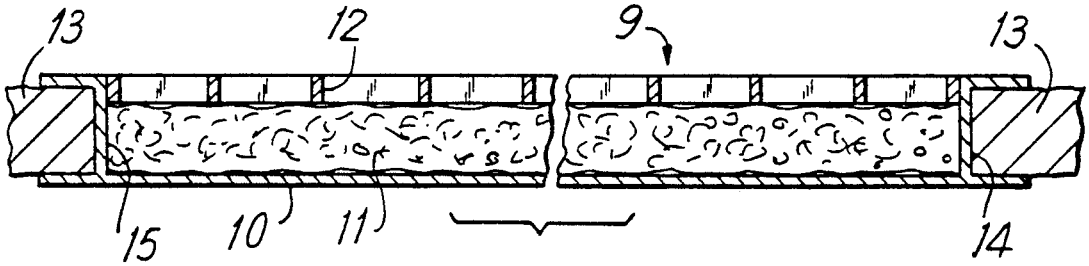
FIG. 2
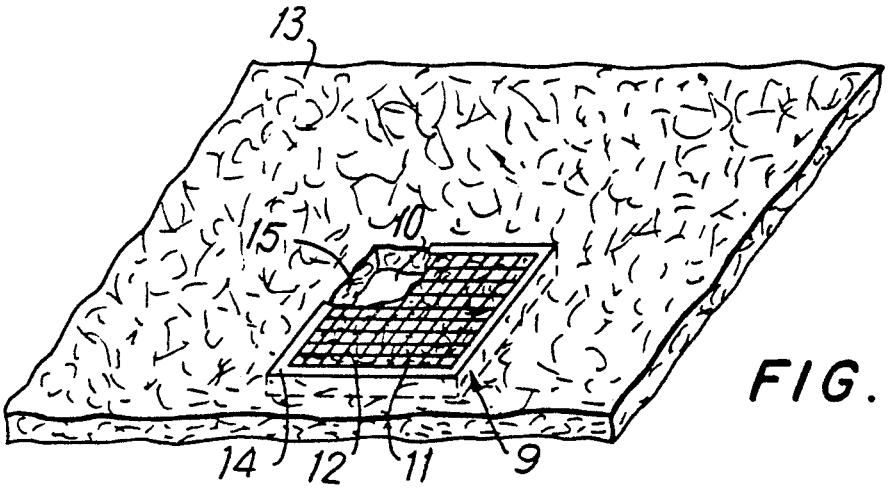
FIG. 3

DEVICE FOR DISINFECTING AND CLEANING PARTS OF PERSONS, ANIMALS AND OBJECTS PASSING OVER IT AND CONTACTING THE GROUND

The invention concerns a device for disinfecting and cleaning those parts of persons, animals and objects generally that come in contact with the ground.

It is known that much dirt is present on the surfaces of roads and outside areas, dirt that includes animal excrement, residue of edible materials and other organic substances likely to contain bacterial flora, viruses etc. Dirt of this kind can easily cause serious diseases of a contagious nature.

Good habits of hygiene include washing and disinfecting the hands, the mouth and the whole body, cleaning clothes, habitations, carpets and shoe uppers but little attention is paid to the soles of footwear and those parts of objects in contact with the ground.

Shoe soles in particular spontaneously pick up infected material which is then carried into homes, offices, hospitals, public places and wherever people walk in. Inside buildings the temperature is regulated for human comfort but at the same time this warmth is perfect for the growth of bacteria and viruses which develop rapidly and spread throughout the environment with harmful effects.

The same drawbacks apply to the passage of animals and any rolling means such as the wheels of wheelchairs, trolleys and the like all of which carry in dirt from outside on feet and wheels.

Patent BE-A-890 907 discloses a sterilizing device that comprises a flat basin containing a spongy cartridge impregnated with a sterilizing product, of the 'disposable' kind with a grating on top of it.

When an object passes over said grating, the compressed cartridges transfers the sterilizing product to the object.

The whole device can be made of cheap material as is usual for disposable kinds of articles.

The cartridge is changed by inserting it into the device from above and it is kept stable by gravity.

Patent EP-A-60148 similar discloses a sterilizing device comprising a replaceable cartridge put in through an aperture at one side.

The drawback to these devices is their operating lifetime prior to cartridge replacement; they need frequent replacement and adequate maintenance. Cartridge performance is obviously limited by their having to be thrown away after use which also means limitations as to size and choice of materials, necessarily cheap.

U.S. Pat. No. 2,989,965 discloses a device for decontamination of radioactive areas.

At the top of a tank of decontaminating liquid there is a fixed platform for feet to stand on, at a level lower than the surface of the liquid which, as it becomes contaminated, can be filtered or replaced.

Replacement is not automatic or spontaneous following the passage of feet so that an operator is needed or some arrangement independent of the movement of people.

SUMMARY OF THE INVENTION

It is an object of the present invention to eliminate or lessen the disadvantages referred to above in an extremely simple device without cartridges to replace, and having means for feeding disinfecting liquid a feed which may even be spontaneous, offering maximum and long-lasting effectiveness.

The device according to the invention disinfects in their passage over it, parts of persons, animals and objects generally that come in contact with the ground, especially the soles of footwear.

In place of the disinfecting cartridge proposed by patent BE-A-890 907, in the present invention the device according to the invention is provided with a container suitable for replenishing the disinfecting liquid transferred to persons, animals and objects generally passing across the device.

According to the invention the device has a shallow flat-bottomed tray containing a flat spongy body impregnated with disinfecting liquid and above the spongy body an elastic grating whose upper surface is practically flush with the edges of the tray. The tray is of a rectangular form and its four sides are channel-shaped, i.e. trough-shaped, in cross section.

The channel-shaped peripheral sides can accommodate the edges of an internal opening cut out in a doormat.

the internal opening in the doormat corresponds to the shape of the tray.

The doormat is laid above a rigid supporting member and used to create a container that supplies the liquid lost by the spongy body when pressed by persons, animals or objects. Close to the tray a container of disinfecting liquid may be placed provided with a distributor for slow, automatic distribution of the liquid to the spongy body.

The distributor can be operated by depression of the grating, the purpose of this being to regulate distribution of the liquid to the spongy body when persons, animale or objects pass across it.

The advantages of the invention are clear. A drastic reduction is made to the disadvantages caused by contact between the ground and parts of persons, animals and objects, these parts having repeated contact between roadways outside and indoor environments.

A simple and effective method is offered to prevent transfer of bacteria and virus present in outdoor dirt inside inhabitated places.

All this can be secured by a low-cost easily-installed method involving no complex operations since disinfection occurs in practice by passage of objects and tread of feet.

BRIEF DESCRIPTION OF THE DRAWING

Characteristics and purposes of the invention will be made even clearer by the following example of its execution illustrated by diagrammatic figures.

FIG. 1 is a perspective view of a portion of a device for disinfecting according to the invention.

FIG. 2 is a transverse cross-sectional view through the part of the device shown in FIG. 1.

FIG. 3 is a perspective view of a device for disinfecting according to the invention including the portion shown in FIG. 1.

DETAILED DESCRIPTION OF THE PREFERRED EMBODIMENT

Figure 4:
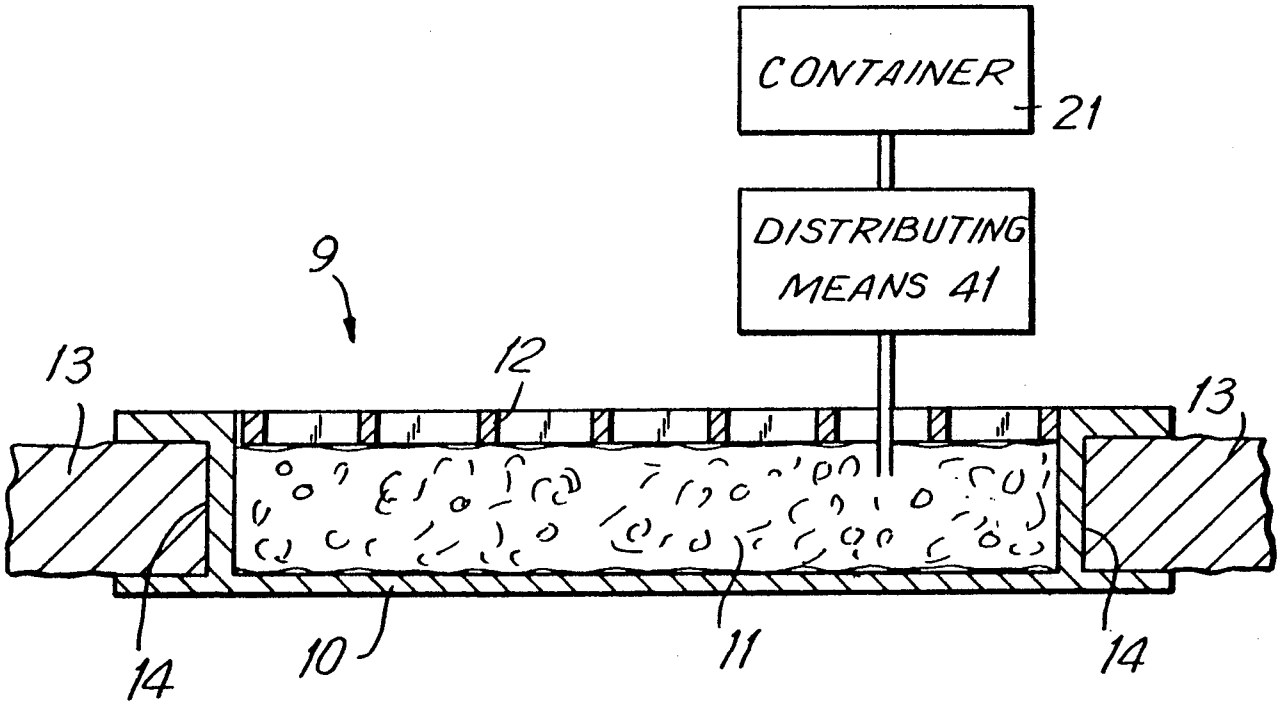
FIG. 4 is a transverse cross-sectional view through another embodiment of the device according to the invention.

The device portion 9 comprises the shallow tray 10 containing a flat spongy body 11 and grating 12 above it, flush with the top edge of the tray and made of moderately elastic material.

The peripheral sides 14 of said tray 10 are C-shaped opening outwards to receive the edges of the four-sided 'window' 15 cut into a doormat 13 of the normal kind.

Disinfecting liquid is poured into the tray until the spongy body 11 is impregnated with it.

Thus fitted up the doormat 13 is placed at the entrance to an indoor environment or at some point of access to the environment.

The weight of a person treading on the grating in the doormat depresses the grating 12 and thereby compresses the spongy body 11 which consequently releases a part of the disinfecting liquid through the grating and onto the sole of the person's footwear.

Then, treading on the doormat 13 which surrounds the tray 10, the soles will leave upon it the already disinfected impurities and can therefore safely walk on indoor floors without fearing the effects of bacteria present in dirty surfaces of roads or any place open to the public.

FIG. 4 shows an alternative preferred embodiment. In this embodiment a container 21 is provided for automatically dispensing disinfecting liquid to replenish or supply disinfecting liquid transferred from the sheet 11 of spongy material to the soles of the shoes pressing and deforming the elastic grating 12. A distributing means 41 can be connected between the container 21 and the sheet 11 of spongy material so that disinfecting liquid can be distributed in a controlled slow manner to the sheet 11 of spongy material.

I claim:

1. Device for disinfecting parts of persons, animals and objects passing thereover and coming into contact with ground, said device comprising a doormat provided with a rectangular aperture;

a shallow flat-bottomed rectangular tray having a bottom and vertical peripheral sides made from metal, each of said peripheral sides being shaped to form a channel having a C-shaped transverse cross-section opening outwards from said rectangular tray; said channel, said aperture and said tray being shaped and dimensioned so that said tray can fit in said aperture with edges of said doormat engaged in said channels of said vertical sides;

a sheet of rectangular spongy material located in said rectangular tray;

a disinfecting liquid impregnating said sheet of said spongy material; and an elastic grating having an upper surface and above said sheet of said spongy material, wherein said elastic grating, said sheet of said spongy material and said rectangular tray are dimensioned so that said upper surface of said elastic grating is approximately flush with top edges of said vertical sides of said rectangular tray and said elastic grating has an elasticity such that, when depressed by said parts of said persons, animals and objects passing thereover, said elastic grating flexes sufficiently to compress said sheet of said spongy material sufficiently to force a portion of said disinfecting liquid residing in said spongy material through said elastic grating to said parts, and such that said elastic grating returns to an original conformation when said parts no longer contact said elastic grating, said upper surface of said elastic grating being substantially coplanar with an upper surface of said doormat in said original conformation.

2. Device as defined in claim 1, further comprising a rigid supporting member below said doormat and structured and positioned to create a reservoir space for said disinfecting liquid.

3. Device as defined in claim 1, further comprising distributing means for controlled automatic distribution of said disinfecting liquid to said sheet of spongy material and a container for supply of said disinfecting liquid via said distributing means.

4. Device as defined in claim 1, further comprising a container of said disinfecting liquid placed near said tray and distributing means operating by deformation of said grating and connected with said container for distributing said disinfection liquid to said spongy material.

* * * * *